US006125909A

United States Patent [19]

Walker et al.

[11] Patent Number: 6,125,909

[45] Date of Patent: Oct. 3, 2000

[54] TRAVERSE ROD ASSEMBLY

[75] Inventors: Richard K. Walker, Temecula, Calif.; Whitney A. Walker, Dallas, Tex.

[73] Assignee: Antique Drapery Rod Company, Dallas, Tex.

[21] Appl. No.: 09/263,600

[22] Filed: Mar. 5, 1999

Related U.S. Application Data

[60] Provisional application No. 60/077,611, Mar. 10, 1998.

[51] Int. Cl.[7] ..... A47H 5/02

[52] U.S. Cl. ..... 160/345; 160/126

[58] Field of Search ..... 160/344, 345, 160/341, 340, 126; 16/87.2, 87.4 R, 87.6 W, 87.4 W, 95 W, 95 DW, 95 D

[56] References Cited

U.S. PATENT DOCUMENTS

| | | | |
|---|---|---|---|
| 548,192 | 10/1895 | Groth | 16/87.4 W |
| 1,662,928 | 3/1928 | Kirsch | 160/345 |
| 3,095,033 | 6/1963 | Polkosnik | 160/345 |
| 3,119,442 | 1/1964 | Ford et al. | 16/87.2 X |
| 3,521,318 | 7/1970 | Johnson | 160/345 X |
| 3,881,218 | 5/1975 | Palmer | 16/87.6 R X |
| 4,190,927 | 3/1980 | Hepperle | 16/87.4 R X |
| 4,881,588 | 11/1989 | Madsen | 160/345 |
| 5,170,531 | 12/1992 | Ryan | 160/341 X |
| 5,560,417 | 10/1996 | Smiley | 160/345 X |

*Primary Examiner*—David M. Purol
*Attorney, Agent, or Firm*—Baker Botts L.L.P.

[57] ABSTRACT

A traverse rod assembly (10) includes a support rod (12) having a viewing side (32) and an opposite backside (34). A track (26) is connected to the backside (34) of the support rod (12), and the track (26) has a sideways opening (36) hidden from the viewing side (32) of the support rod (12). A set of sliders (28) has a first section (54) slidably disposed within the track (26) and a second section (56) extending from the first section (54) through the sideways opening (36) in the track (26). A curtain support (30) is connected to the second section (56) of each of at least a subset of the sliders (28), and the curtain support (30) is operable to support at least part of a drapery (16).

30 Claims, 3 Drawing Sheets

TRAVERSE ROD ASSEMBLY

RELATED APPLICATION

This application claims the benefit of U.S. Provisional Application Ser. No. 60/077,611, filed Mar. 10, 1998.

TECHNICAL FIELD OF THE INVENTION

This invention relates generally to drapery rods, and more particularly to an improved traverse rod assembly.

BACKGROUND OF THE INVENTION

Conventional traverse rods generally include a set of carriers, each of which is attached to a curtain. A master carrier is used to open and close the curtain, with each carrier being attached to the next carrier by the curtain. As the master carrier pulls the curtain, the curtain pulls the next carrier and so forth until the end of the curtain is reached. This use of the curtain to pull the carriers results in stress on the fabric of the curtain which may eventually cause tearing.

In addition, conventional traverse rods generally are of metal design and require the use of a custom bracket to attach the rod to a wall or ceiling. Typically, these rods do not have conventional circular curtain rings for attaching the curtain to the rod but use a hole in the carrier to hold the curtain. These rods also generally do not allow a decorative finial to be attached to the ends of the rod with the exception of a design that uses a hollow metal finial that loosely fits into the end of a metal rod. Because of this, many conventional finials cannot be used with these types of rods.

SUMMARY OF THE INVENTION

In accordance with the present invention, an improved traverse rod assembly is provided that substantially eliminates or reduces the disadvantages or problems associated with previously developed traverse rods. In particular, the present invention provides a traverse rod that allows a curtain to be opened and closed without stress on the curtain.

In one embodiment of the present invention, a traverse rod assembly includes a support rod having a viewing side and an opposite backside. A track is connected to the backside of the support rod. The track has a sideways opening hidden from the viewing side of the support rod. A set of sliders has a first section slidably disposed within the track and a second section extending from the first section through the sideways opening in the track. A curtain support is connected to the second section of each of at least a subset of the sliders. The curtain support is operable to support at least part of a drapery.

In accordance with another embodiment of the present invention, a support assembly for opening and closing a drapery includes a set of curtain supports. The set of curtain supports is operable to encircle a support rod and support at least part of a drapery. The curtain supports include a lead curtain support coupled to a flexible member. The curtain supports include a plurality of remaining curtain supports coupled to the flexible member at preselected spaced distances from the lead curtain support such that movement of the lead curtain support along the support rod pulls the remaining curtain supports along the support rod at the preselected spaced distances.

Technical advantages of the present invention include providing an improved traverse rod assembly. In particular, each curtain ring spaces itself independently of the curtain. As a result, there is a reduction in stress on the fabric of the curtain and a corresponding reduction in tearing of the fabric. Another technical advantage of the present invention includes providing a support assembly that allows the use of conventional circular curtain rings and conventional brackets with a wood curtain rod.

Other technical advantages of the present invention will be readily apparent to one skilled in the art from the following figures, description and claims.

BRIEF DESCRIPTION OF THE DRAWINGS

For a more complete understanding of the present invention, and its advantages thereof, reference is now made to the following description taken in conjunction with the accompanying drawings in which.

DETAILED DESCRIPTION OF THE INVENTION

The preferred embodiments of the present invention and its advantages are best understood by referring now in more detail to FIGS. 1 through 8 of the drawings, in which like numerals refer to like parts.

Figure 1:
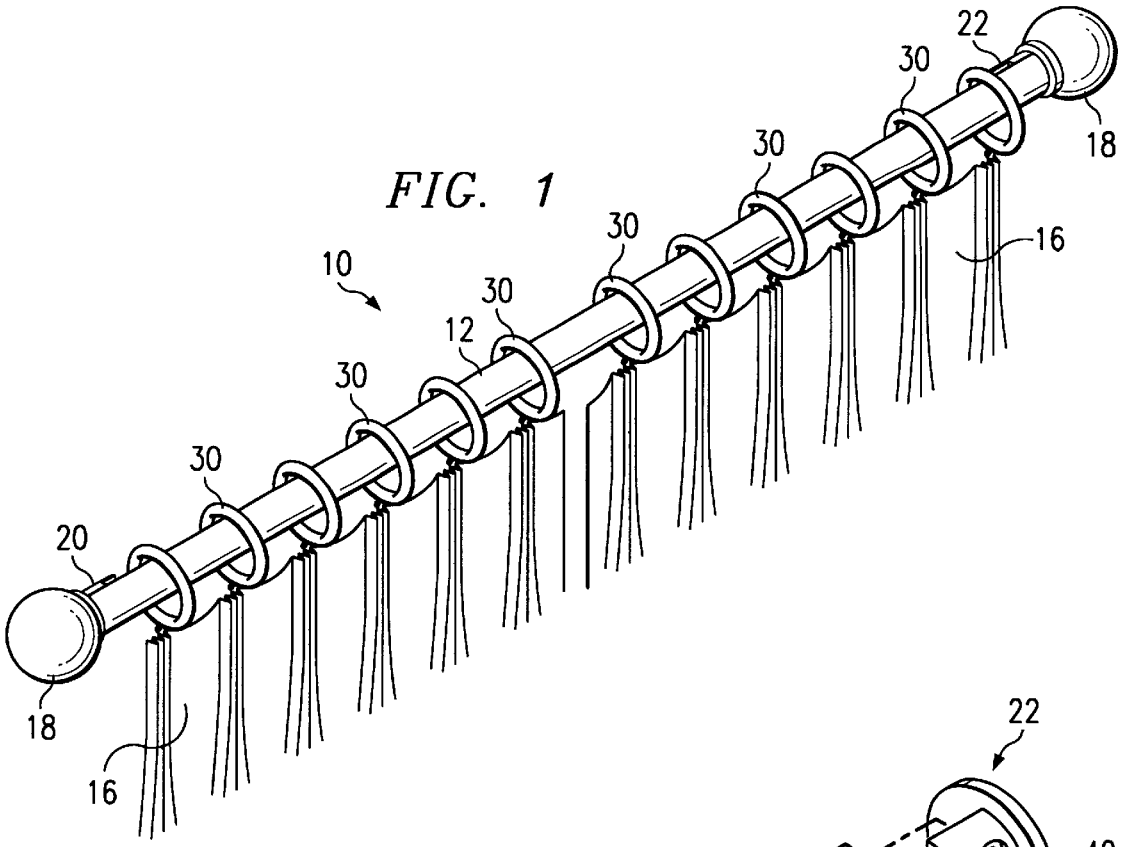
FIG. 1 is a perspective view illustrating a drapery installation utilizing the traverse rod assembly of the present invention.

FIG. 1 is a perspective view illustrating a drapery installation utilizing a traverse rod assembly 10 in accordance with one embodiment of the present invention. The traverse rod assembly 10 is used for hanging curtains and allows them to be opened and closed by conventional curtain rings that space themselves independently of the curtain. One feature of this design is the use of a wood support rod 12 that may be attached to a wall by use of a conventional bracket. Special brackets are not required. The support rod 12 may support a drapery 16 and provides for the use of conventional finials 18.

Figure 2:
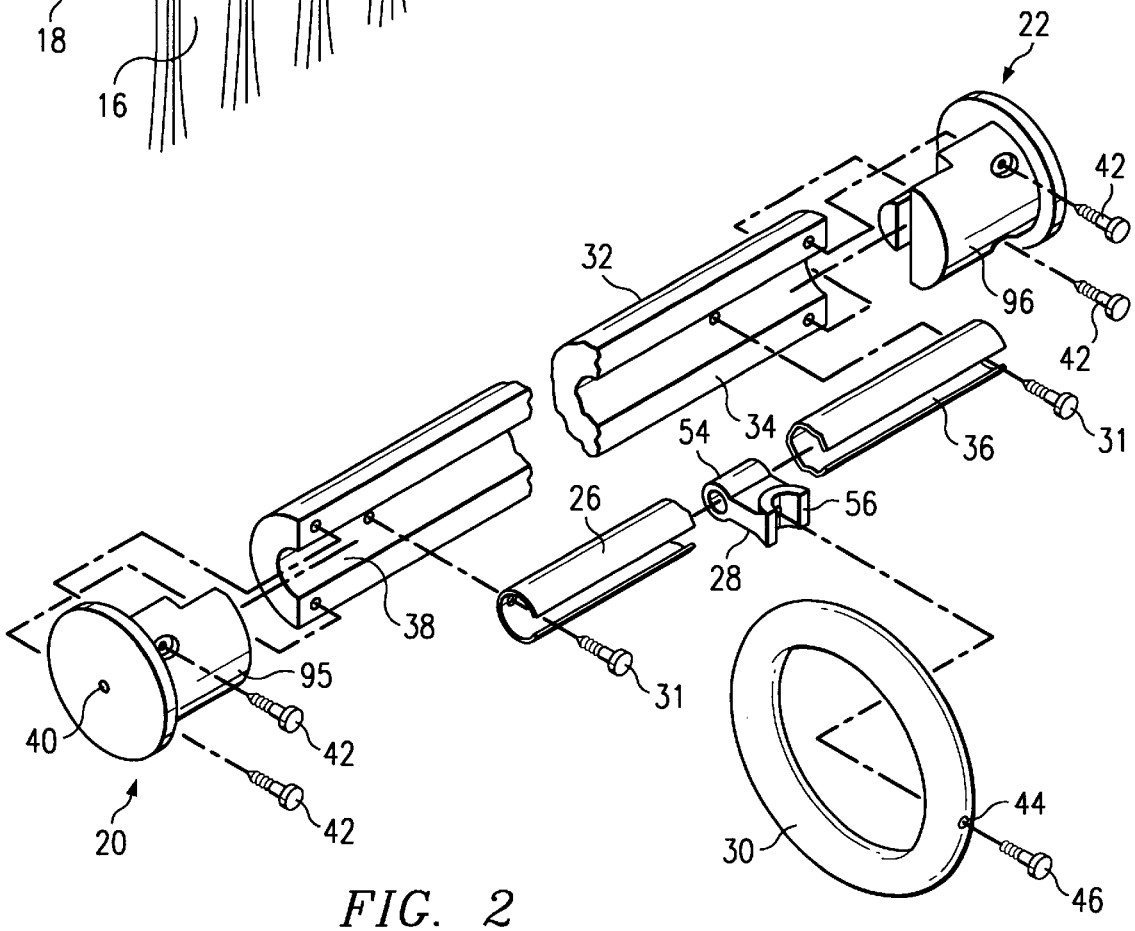
FIG. 2 is an exploded view of the traverse rod assembly of FIG. 1 illustrating the support rod, track, slider, curtain ring, retention screws and end caps.

FIG. 2 is an exploded view of the traverse rod assembly 10 of FIG. 1 illustrating the support rod 12, end caps 20 and 22, track 26, slider 28, curtain ring 30, and retention screws 31. In one embodiment, the support rod 12 is semicircular in shape, with a rounded viewing side 32 and an opposite, hidden backside 34. The support rod 12 is rigid and may be made of wood, metal, or other suitable material. The support rod 12 is grooved to provide a holding capability for the track 26, which in this embodiment is tubular. It will be understood that the support rod may be otherwise suitably shaped.

The track 26 may be made of a metal, such as steel or other suitable material. A sideways opening 36 hidden from the viewing side 32 is cut down the length of the track 26. Two retention screws 31 are used to attach the track 26 to a groove 38 in the backside 34 of the support rod 12. The track 26 may also be glued to the support rod 12 for additional strength.

End caps 20 and 22 attach to the ends of the support rod 12 and permit movement of a pull cord to open and close the drapes 16. The end caps 20 and 22 also permit attachment of a conventional finial 18. FIG. 1 shows a conventional finial 18 screwed into the end caps 20 and 22. As shown in FIG. 2, a threaded hole 40 in the end cap 20 accepts the screw of a conventional finial 18. In one embodiment, the track 26 is shorter than the support rod 12 to permit room for the end caps 20 and 22. In this embodiment, the end caps 20 and 22 are fitted into the groove 38 in the support rod 12 and screwed in place with end cap screws 42.

The sliders 28 slide inside the track 26 to open and close the drapes 16, with the exception of end sliders 84 at the far ends of the support rod 12. Each slider 28 has a first section 54 that is slidably disposed within the track 26 and a second section 56 extending from the first section 54 through the sideways opening 36 in the track 26. End sliders 84 (FIG. 4) are held in place proximate to the ends of the support rod 12 by the retention screws 31 so that the drapery is anchored at each end of the traverse rod assembly.

A curtain ring 30 is attached to each slider 28 through a hole 44 placed in the ring 30 and a screw 46 used to screw the ring 30 to the slider 28. The curtain ring 30 is a conventional curtain ring or other suitable support. In one embodiment, the curtain ring 30 completely encircles the support rod 12 and may be constructed of wood, metal or other suitable material.

Figure 3:
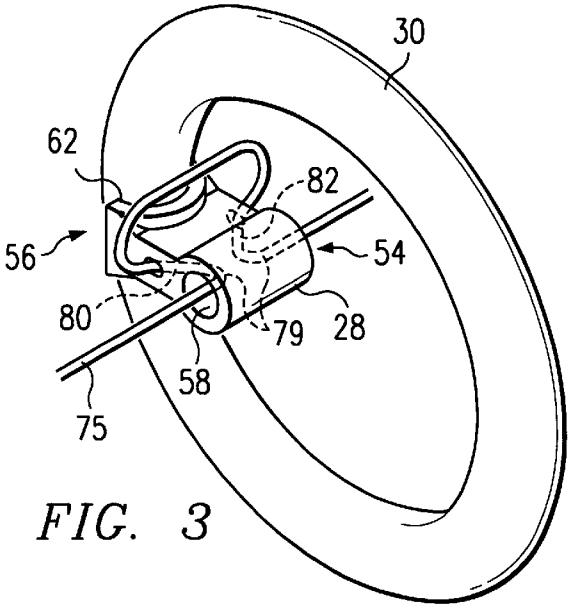
FIG. 3 is a detailed view illustrating the internal cavity and frictional passageway of the slider of FIG. 2.

FIG. 3 is a detailed view illustrating details of the slider 28 of FIG. 2 in accordance with one embodiment of the present invention. In this embodiment, the slider 28 is preferably of a molded, unitary construction. As shown by FIG. 3, the first section 54 is cylindrical in shape. This cylindrical first section 54 is adapted to be slidably received within the tubular track 26. The first section 54 comprises an internal cavity 58 having a longitudinal axis substantially parallel to the longitudinal axis of the track 26. The internal cavity 58 is sized to pass a pull cord 60 for positioning the slider 28 within the track 26.

The second section 56 of the slider 28 extends substantially perpendicular to the first section 54 and comprises a distal end 62 that is adapted to receive a curtain support 30. The curtain support 30 may be screwed to the distal end 62 of the second section 56 of the slider 28 as shown in FIG. 2. Alternatively, the curtain support 30 may be glued or otherwise suitably coupled to the slider 28.

The slider 28 comprises a frictional passageway 79 that is operable to fixably receive a flexible member 75. As described in more detail below, the flexible member 75 interconnects a set of sliders 28 at preselected spaced distances 78. The frictional passageway 79 comprises a first passage 80 that extends from the internal cavity 58 to an exterior of the slider 28 and a second passage 82 that extends from the exterior of the slider 28 back into the internal cavity 58. The first and second passages 80 and 82 are elongated, narrow, and non-parallel such that the flexible member 75 is frictionally held, or fixed, within the frictional passageway 79. In addition, the first and second passages 80 and 82 open at opposing sides of the exterior of the second section 56 of the slider 28 such that the flexible member 75 can pass from the first passage 80 to the second passage 82 outwardly of the opening 36 in the track 26. It will be understood that the frictional passageway 79 may be otherwise suitably configured.

Figure 4:
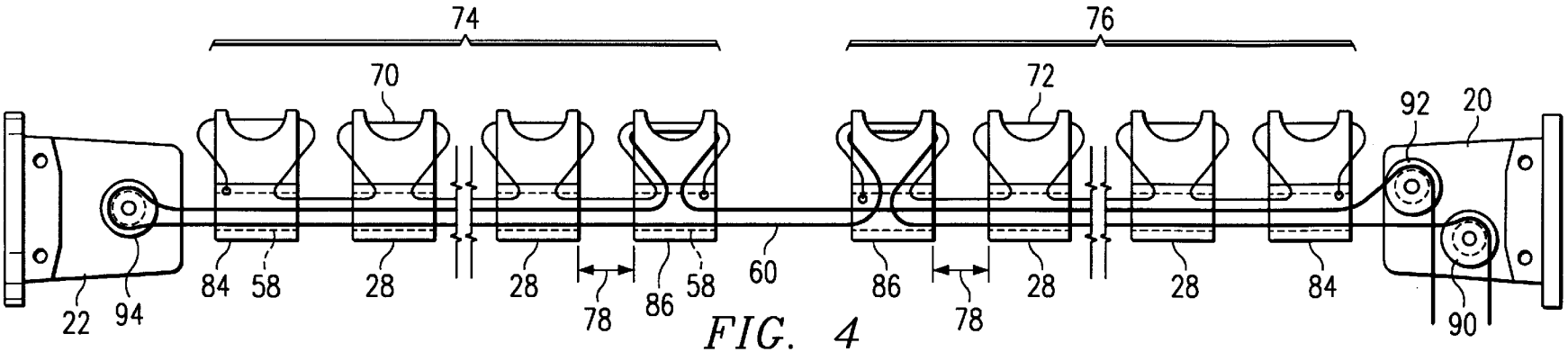
FIG. 4 is a fragmentary perspective view illustrating the connection of a pull cord and flexible member to the sliders for opening and closing the drapery of FIG. 1.

FIG. 4 is a fragmentary perspective view illustrating the connection of a pull cord 60 and connecting links 70 and 72 to the sliders 28 for opening and closing the drapes 16 of FIG. 1. The connecting links 70 and 72 are each a flexible member which may be made of plastic, cotton, jointed stiff members, or other suitable construction. The flexible members may be any item that allows the sliders 28 to be pulled apart at preselected distances and pushed within close proximity of each other.

FIGS. 3 and 4 depict the routing of connecting links 70 and 72 which each pass through at set of sliders 28. A first connecting link 70 passes through a first set of the sliders 74, and a second connecting link 72 passes through a second set of the sliders 76. The ends of the connecting links 70 and 72 are terminated, or free, at the ends of the end and lead sliders 84 and 86 for each slider set. Each set of sliders 74 and 76 supports a different section of the drapes 16. The design of the slider 28 permits each set to be fixed to a link 70 or 72 at preselected distances 78 (not to scale) from each other, and thus from a lead slider, without the use of clamps or other devices.

A pull cord 60 is routed through each slider 28 and attached to the two lead sliders 86 in order to allow manipulation of the sliders 28 by the pull cord 60. The lead slider 86 is the innermost slider 28 of each set 74 and 76. The pull cord 60 follows the same path through the lead slider 86 as the connecting link 70 or 72. The pull cord 60 is routed through the internal cavity 58 of the non-lead sliders 28. The pull cord 60 is continuous through the sliders 28 and the free ends are outside the sliders 28 and the track 26. In operation, each lead slider 86 pulls, via the flexible member 75, the other sliders 28 in its set toward the center of the support rod 12 to close the drapes 16 or pushes the other sliders 28 away from the center to open the drapes 16.

Figure 6:
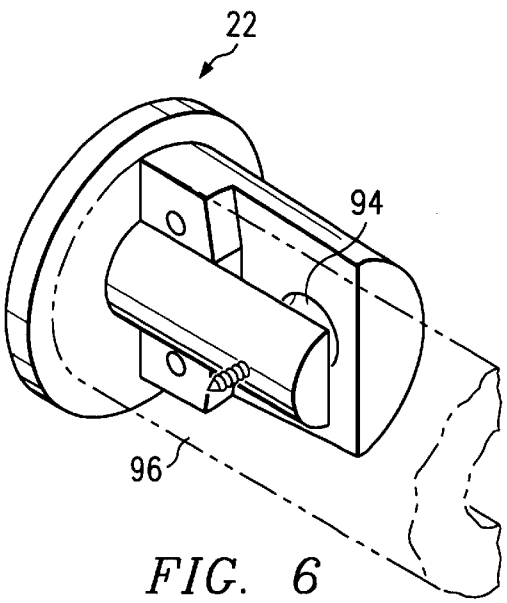
FIG. 6 is a detailed view illustrating the single pulley of the second end cap of FIG. 2.
Figure 5:
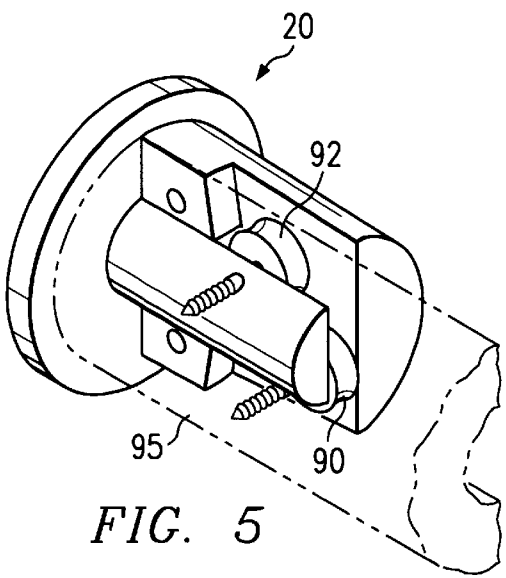
FIG. 5 is a detailed view illustrating the double pulleys of the first end cap of FIG. 2.

FIG. 5 is a detailed view illustrating the double pulleys 90 and 92 of the first end cap 20 of FIG. 2, and FIG. 6 is a detailed view illustrating the single pulley 94 of the second end cap 22 of FIG. 2. In the embodiment shown in FIGS. 2, 5 and 6, the first end cap 20 forms a generally circular first end 95 of the traverse rod assembly 10 in connection with the support rod 12 and the second end cap 22 forms a generally circular second end 96 of the traverse rod assembly 10 in connection with the support rod 12. Each end cap 20 and 22 includes a threaded hole 40 that accepts a #14–20 or other screw of a conventional finial 18.

The end caps 20 and 22 provide for the routing of the pull cord 60 and they permit the attachment of conventional finials 18 that have mounting screws. The first end cap 20 is a pull cord exit end cap that allows each end of the pull cord 60 to come out of the track 26 and hang down where it may be accessed by an operator. The first end cap 20 has a first pulley 90 and a second pulley 92, one for each end of the pull cord 60.

The second end cap 22 is a return end cap, as shown in FIG. 6. The second end cap 22 has a third pulley 94 that permits the pull cord 60 to come out of the track 26 and return back into the track 26. The routing of the pull cord 60 through the first end cap 20 and the second end cap 22 is shown in FIG. 4. The pull cord 60 extends around the first pulley 90, through the track 26, around the third pulley 94, back through the track 26 and around the second pulley 92.

Figure 7:
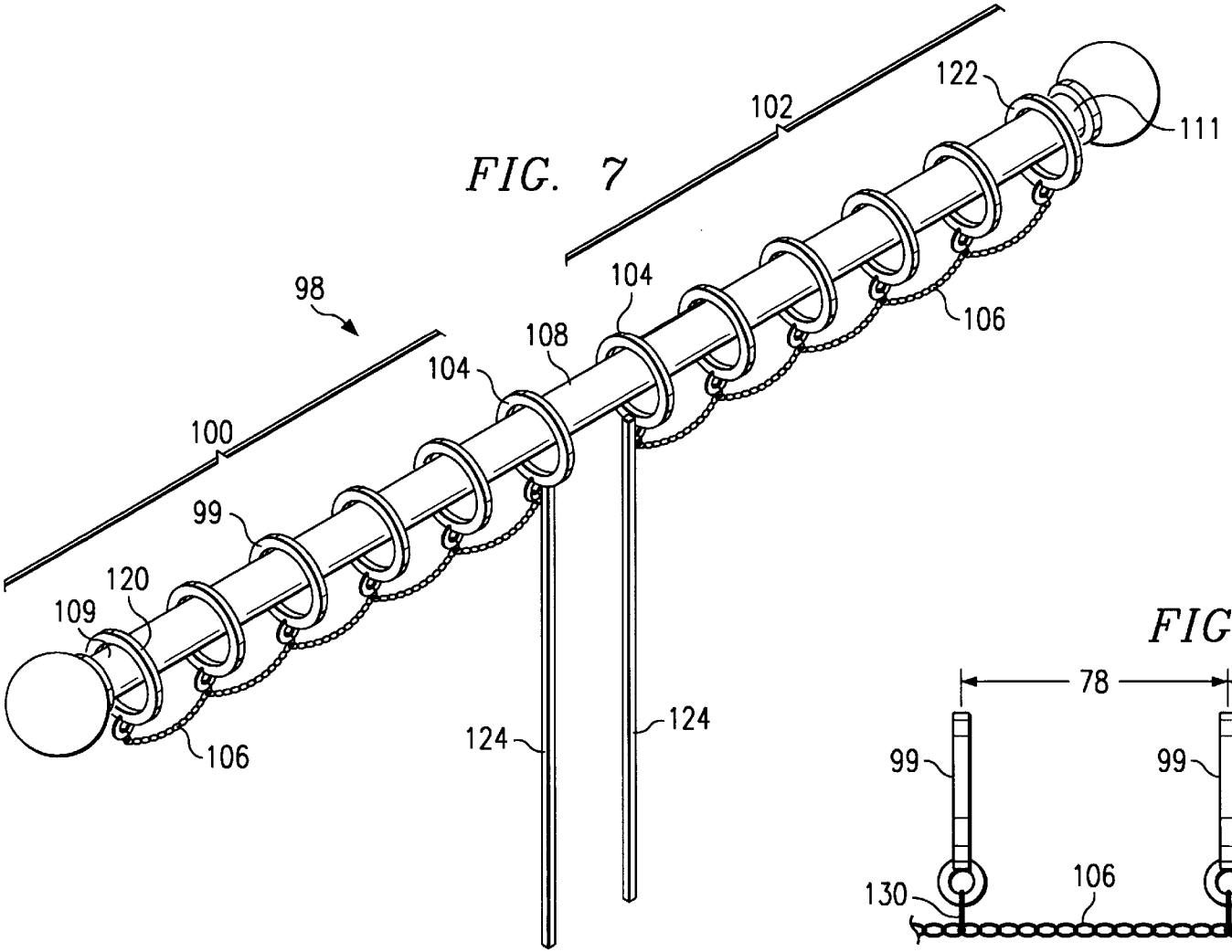
FIG. 7 is a perspective view illustrating a support assembly in accordance with one embodiment of the present invention.
Figure 8:
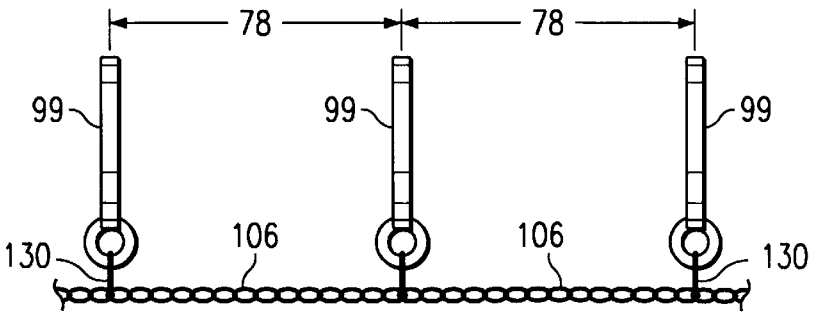
FIG. 8 is a fragmentary perspective view illustrating connection of the flexible member to the curtain supports of FIG. 7.

FIG. 7 is a perspective view illustrating a support assembly 98 in accordance with another aspect of the present invention. FIG. 8 is a detailed view illustrating a connection of a flexible member 106 to the curtain supports 99 of FIG. 7. In one embodiment, the curtain supports 99 may be conventional curtain rings that encircle a supporting member.

Referring to FIGS. 7 and 8, a set of curtain rings 100 or 102, each including a lead curtain ring 104, is adjustably connected to a flexible member 106. The flexible member 106 may be a chain link or other suitable material that allows the rings to be pulled apart at preselected distances and pushed within close proximity of each other. The remaining curtain rings 99 are coupled to the flexible member 106 at preselected spaced distances 78 from the lead curtain ring 104, and thus from each other. This allows movement of the lead curtain ring 104 to pull the remaining curtain rings 99 at the preselected spaced distances 78.

As shown in FIG. 8, the curtain rings 99 are each coupled to the flexible member 106 by a connecting ring 130 which loops through a portion of the curtain ring 99 and the flexible member 106. The preselected spaced distances 78 between curtain rings 99 may be adjusted by changing the locations at which the flexible member 106 is connected to the connecting rings 130, and thus the curtain rings 99. The connecting rings 130 may also be used to attach a drape to the curtain rings 99.

As shown in FIG. 7, the curtain rings 99 may be divided into a first set 100 and a second set 102, with each set connected to a separate flexible member 106. This may be used for a center-cut drapery. In an alternative embodiment, there may be only one set of curtain rings 99 connected to one flexible member 106. This may be used for a single section of drapery.

The curtain rings 99 may be placed on a conventional support rod 108 made of wood, metal, or other suitable material. A drapery may be hung from the rings 99 by connection hooks or other suitable connectors. The conventional support rod 108 has a first end 109 and a second end 111. In the embodiment shown in FIG. 7, the first set of curtain rings 100 includes a first end curtain ring 120 that is substantially fixed proximate to the first end 109. Also, the second set of curtain rings 102 includes a second end curtain ring 122 that is substantially fixed proximate to the second end 111. The end curtain rings 120 and 122 may be secured, nailed, sheared or otherwise secured to the support rod 108. Alternatively, an end of the flexible member 106 may be secured to the support rod 108.

Wands 124 are coupled to each of the lead curtain rings 104, such that the wands 124 may be used to pull or push the lead curtain rings 104 and thus open or close supported drapes. The wands 124 may be constructed of wood, metal, or other suitable material.

While the invention has been particularly shown and described by the foregoing detail description, it will be understood by those skilled in the art that various other changes in form and detail may be made without departing from the spirit and scope of the invention.

What is claimed is:

1. A traverse rod assembly, comprising:

a support rod having a viewing side and an opposite back side;

a track connected to the back side of the support rod, the track having a sideways opening hidden from the viewing side of the support rod;

a set of sliders each having a first section slidably disposed within the track and a second section extending from the first section through the sideways opening in the track, the first section having an internal cavity operable to pass a cord through the track; and a curtain support connected to the second section of each of at least a subset of the sliders, the curtain support operable to support at least part of a drapery.

2. The traverse rod assembly of claim 1, wherein the track is tubular.

3. The traverse rod assembly of claim 1, wherein the support rod and track are rigid.

4. The traverse rod assembly of claim 1, wherein the support rod is constructed of wood.

5. The traverse rod assembly of claim 2, wherein the tubular track is constructed of a solid steel tube in which the sideways opening is cut.

6. The traverse rod assembly of claim 1, further comprising the track recessed in a groove formed in the back side of the support rod.

7. The traverse rod assembly of claim 2, wherein the first section of the slider disposed in the tubular track is rounded.

8. The traverse rod assembly of claim 2, wherein the first section of the slider disposed in the tubular track is generally cylindrical in shape and has a longitudinal axis substantially parallel to a longitudinal axis of the tubular track.

9. The traverse rod assembly of claim 1, the second section of the slider comprising a distal end adapted to receive the curtain support.

10. The traverse rod assembly of claim 1, wherein the curtain support is a ring completely surrounding the support rod and the track.

11. The traverse rod assembly of claim 10, wherein the ring is a conventional curtain ring constructed of wood.

12. A traverse rod assembly, comprising:

a support rod having a viewing side and an opposite back side;

a track connected to the back side of the support rod, the track having a sideways opening hidden from the viewing side of the support rod;

a set of sliders each having a first section slidably disposed within the track and a second section extending from the first section through the sideways opening in the track;

a curtain support connected to the second section of each of at least a subset of the sliders, the curtain support operable to support at least part of a draper;

a first end cap disposed at a first end of the support rod, the first end cap having a first and a second pulley;

a second end cap disposed at an opposite second end of the support rod, the second end cap having a third pulley;

the track disposed between the first and second end caps;

a cord extending around the first pulley, through the track, around the third pulley, back through the track and around the second pulley; and the sliders each having an internal cavity in which the cord passes through the track.

13. The traverse rod assembly of claim 12, further comprising:

the set of sliders being a first set of sliders disposed within a first segment of the track;

the first set of sliders having a lead slider fixably connected to the cord between the first and third pulleys;

a second set of sliders each having a first section slidably disposed within a second segment of the track and a second section extending from the first section through the sideways opening in the track;

the second set of sliders having a lead slider fixably connected to the cord between the second and third pulleys; and wherein movement of the cord in either direction is operable to move the lead sliders in opposite directions along the track.

14. The traverse rod assembly of claim 13, further comprising:

a first end slider substantially fixed in the first segment of the track proximate to the first end cap; and a second end slider substantially fixed in the second segment of the track proximate to the second end cap.

15. The traverse rod assembly of claim 1, further comprising:

the set of sliders including a lead slider fixably connected to a flexible member; and at least a subset of the remaining sliders fixably connected to the flexible member at preselected spaced distances from the lead slider such that movement of the lead slider in a first direction pulls the remaining sliders in the first direction at the preselected spaced distances.

16. The traverse rod assembly of claim 15, wherein each of at least a subset of the sliders fixably connected to the flexible member comprise a frictional passageway operable to fixably receive the flexible member.

17. The traverse rod assembly of claim 12, wherein the first end cap forms a generally circular first end of the rod assembly in connection with the support rod and the second end cap forms a generally circular second end of the rod assembly in connection with the support rod.

18. The traverse rod assembly of claim 1, further comprising a first end cap and a second end cap each adapted to receive a conventional screw-mounted finial.

19. A slider for opening and closing draperies in connection with a traverse rod assembly having a tubular track, comprising:

a generally cylindrical first section adapted to be slidably received within the tubular track of the traverse rod assembly;

the first section comprising an internal cavity having a longitudinal axis substantially parallel to a longitudinal axis of the first section, the internal cavity sized to pass a cord for positioning the slider within the tubular track of the traverse rod assembly; and a second section extending substantially perpendicular to the first section, the second section comprising a distal end adapted to receive a curtain support.

20. The slider of claim 19, the slider further comprising a frictional passageway operable to fixably receive a flexible member for interconnecting the slider to other sliders at preselected spaced distances along the flexible member.

21. The slider of claim 20, the frictional passageway further comprising:

a first passage extending from the internal cavity to an exterior of the slider; and a second passage extending from the exterior of the slider back to the internal cavity.

22. The slider of claim 21, wherein the first and second passages are non-parallel.

23. The slider of claim 21, wherein the first and second passages open at the exterior of the slider on one or more sides of the second section such that the flexible member can pass from the first passage to the second passage outwardly of an opening of the tubular track through which the second section is adapted to extend.

24. The slider of claim 23, wherein the first and second passages open on opposite sides of the second section of the slider.

25. The slider of claim 19, wherein the slider is constructed of metal.

26. A support assembly for opening and closing a drapery, comprising:

a set of curtain supports operable to encircle a trackless support rod and support at least part of a drapery;

the curtain supports including a lead curtain support coupled to a flexible member; and the curtain supports including a plurality of remaining curtain supports coupled to the flexible member at preselected spaced distances from the lead curtain support such that movement of the lead curtain support along the support rod pulls the remaining curtain supports along the support rod at the preselected spaced distances.

27. The support assembly of claim 26, further comprising a wand coupled to the lead curtain support, wherein the wand is operable to pull the lead curtain support.

28. The support assembly of claim 26, wherein the set of curtain supports is constructed of wood.

29. The support assembly of claim 26, wherein the set of curtain supports is constructed of metal.

30. The support assembly of claim 26, wherein the preselected spaced distances may be adjusted by changing the locations at which the flexible member is coupled to the set of curtain supports.

* * * * *